US012752177B2

(12) United States Patent
Lin

(10) Patent No.: US 12,752,177 B2
(45) Date of Patent: Oct. 6, 2026

(54) APPARATUS FOR SWITCHING TWO ROLLERS OF A SKATE BETWEEN AN IN-LINE POSITION AND A SIDE-BY-SIDE POSITION

(71) Applicant: Jong-Yuan Lin, Taichung (TW)

(72) Inventor: Jong-Yuan Lin, Taichung (TW)

( * ) Notice: Subject to any disclaimer, the term of this patent is extended or adjusted under 35 U.S.C. 154(b) by 248 days.

(21) Appl. No.: 18/752,359

(22) Filed: Jun. 24, 2024

(65) Prior Publication Data

US 2025/0387692 A1 Dec. 25, 2025

(51) Int. Cl.
*A63C 17/00* (2006.01)
*A63C 17/06* (2006.01)

(52) U.S. Cl.
CPC ..... *A63C 17/0073* (2013.01); *A63C 17/06* (2013.01)

(58) Field of Classification Search
CPC ..... A63C 17/0073; A63C 17/06; A63C 17/04; A63C 17/02; A63C 17/008; A63C 2203/06; A63C 17/015; A63C 1/14; A63C 2203/00
See application file for complete search history.

(56) References Cited

U.S. PATENT DOCUMENTS

| | | | | | |
|---|---|---|---|---|---|
| 3,501,162 | A * | 3/1970 | Toone | A63C 17/22 | 280/11.233 |
| 6,290,242 | B1 * | 9/2001 | Ludwig | A63C 17/22 | 280/11.233 |
| 11,951,381 | B2 * | 4/2024 | Owen | A63C 17/06 | |
| 2003/0045411 | A1 * | 3/2003 | Lin | A63B 26/003 | 482/148 |
| 2010/0007105 | A1 * | 1/2010 | Cares | A63C 17/1436 | 280/11.223 |

FOREIGN PATENT DOCUMENTS

| | | | | |
|---|---|---|---|---|
| CN | 205699348 U | * | 11/2016 | |
| CN | 215025912 U | * | 12/2021 | A63C 17/064 |
| IT | RE20020042 A1 | * | 11/2003 | A63C 17/004 |
| KR | 100722369 B1 | * | 5/2007 | A63C 17/16 |
| KR | 102849613 B1 | * | 8/2025 | A63C 17/06 |
| WO | WO-9603187 A1 | * | 2/1996 | A63C 17/02 |
| WO | WO-9964124 A1 | * | 12/1999 | A63C 17/06 |

OTHER PUBLICATIONS

IT-RE20020042-A1 English Translation (Year: 2003).*
KR-102849613-B1 English Translation (Year: 2025).*
KR-100722369-B1 English Translation (Year: 2007).*
WO-9603187-A1 English Translation (Year: 1996).*
CN-215025912-U English Translation (Year: 2021).*
WO-9964124-A1 English Translation (Year: 1999).*
CN-205699348-U English Translation (Year: 2016).*

* cited by examiner

*Primary Examiner* — Michael T. Walsh
(74) *Attorney, Agent, or Firm* — Wang Law Firm, Inc.

(57) ABSTRACT

A roller skate includes a sole, a beam, a fastening unit, supporting elements and connecting units. The sole includes bores around an aperture. The beam includes an orifice between two recesses and stepped holes in communication with the recesses. The fastening unit includes a nut engaged with a threaded bolt inserted in the orifice and the aperture. Each of the supporting elements includes an arched portion for supporting a roller and a positioning portion formed on the arched portion and insertable in a selected one of the recesses. Each of the connecting units includes a detent and a spring. The detent is movable in a corresponding one of the stepped holes. The spring is compressed between the detent and a shoulder of one of the stepped holes so that the spring tends to push the detent in one of the bores.

4 Claims, 6 Drawing Sheets

APPARATUS FOR SWITCHING TWO ROLLERS OF A SKATE BETWEEN AN IN-LINE POSITION AND A SIDE-BY-SIDE POSITION

BACKGROUND OF INVENTION

1. Field of Invention

The present invention relates to a roller skate and, more particularly, an apparatus for switching two rollers of a skate between an in-line position and a side-by-side position.

2. Related Prior Art

Skating is a popular sport. To this end, roller skates are used in places without ice. A roller skate includes four rollers. In a first type, the rollers are sorted into a front pair and a rear pair. In one of the pairs, the rollers are located side by side. In a second type, the rollers are arranged in a line. Each of the types is operable to play some tricks better than the other type. To play all tricks well, two types of roller skates are needed.

CN205699348 discloses an apparatus for switching rollers of a skate between an in-line position and a side-by-side position. To this end, a primary nut (13) and two secondary nuts (14) are slackened to allow a positioning plate (7) and a roller-supporting unit (9) to be switched between the in-line position and the side-by-side position. Then, the primary nut (13) and the secondary nuts (14) are tightened to keep the rollers in the in-line position or the side-by-side position.

Problems are however encountered in use of the foregoing apparatus.

Firstly, it requires a tool to rotate the primary nut (13) and the secondary nuts (14). It is time and labor-demanding to rotate the primary nut (13) and the secondary nuts (14).

Secondly, the secondary nuts (14) must be located in recesses (6). It is time-demanding to place the secondary nuts (14) in the recesses (6) because the secondary nuts (14) are polygonal, and so are the recesses (6).

The present invention is therefore intended to obviate or at least alleviate the problems encountered in the prior art.

SUMMARY OF INVENTION

It is the objective of the present invention to provide a roller skate with rollers easily switchable between an in-line position and a side-by-side position.

To achieve the foregoing objective, the roller skate includes a boot, a beam, a fastening unit, supporting elements, and connecting units. The boot includes a sole formed with multiple bores around an aperture. The beam includes an orifice between two recesses and two stepped holes in communication with the recesses. The fastening unit includes a nut engaged with a threaded bolt inserted in the orifice and the aperture. Each of the supporting elements includes an arched portion for supporting a roller and a positioning portion formed on the arched portion and insertable in a selected one of the recesses. The roller is connected to the arched portion. Each of the connecting units includes a detent and a spring. The detent is movable in a corresponding one of the stepped holes. The spring is compressed between the detent and a shoulder of a corresponding one of the stepped holes so that the spring tends to push the detent in a selected one of the bores.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
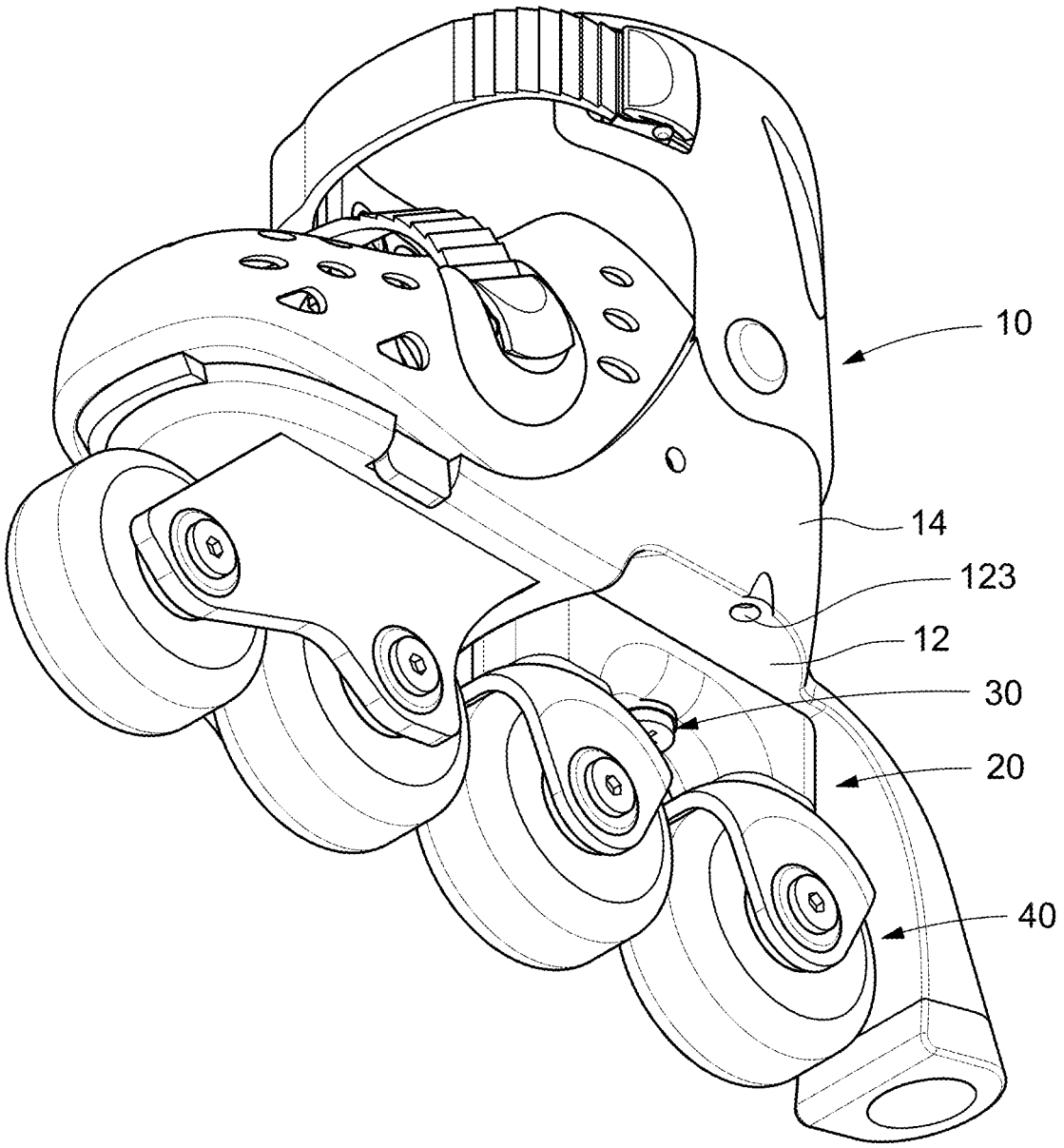
FIG. 1 is a perspective view of a roller skate according to the preferred embodiment of the present invention.
Figure 2:
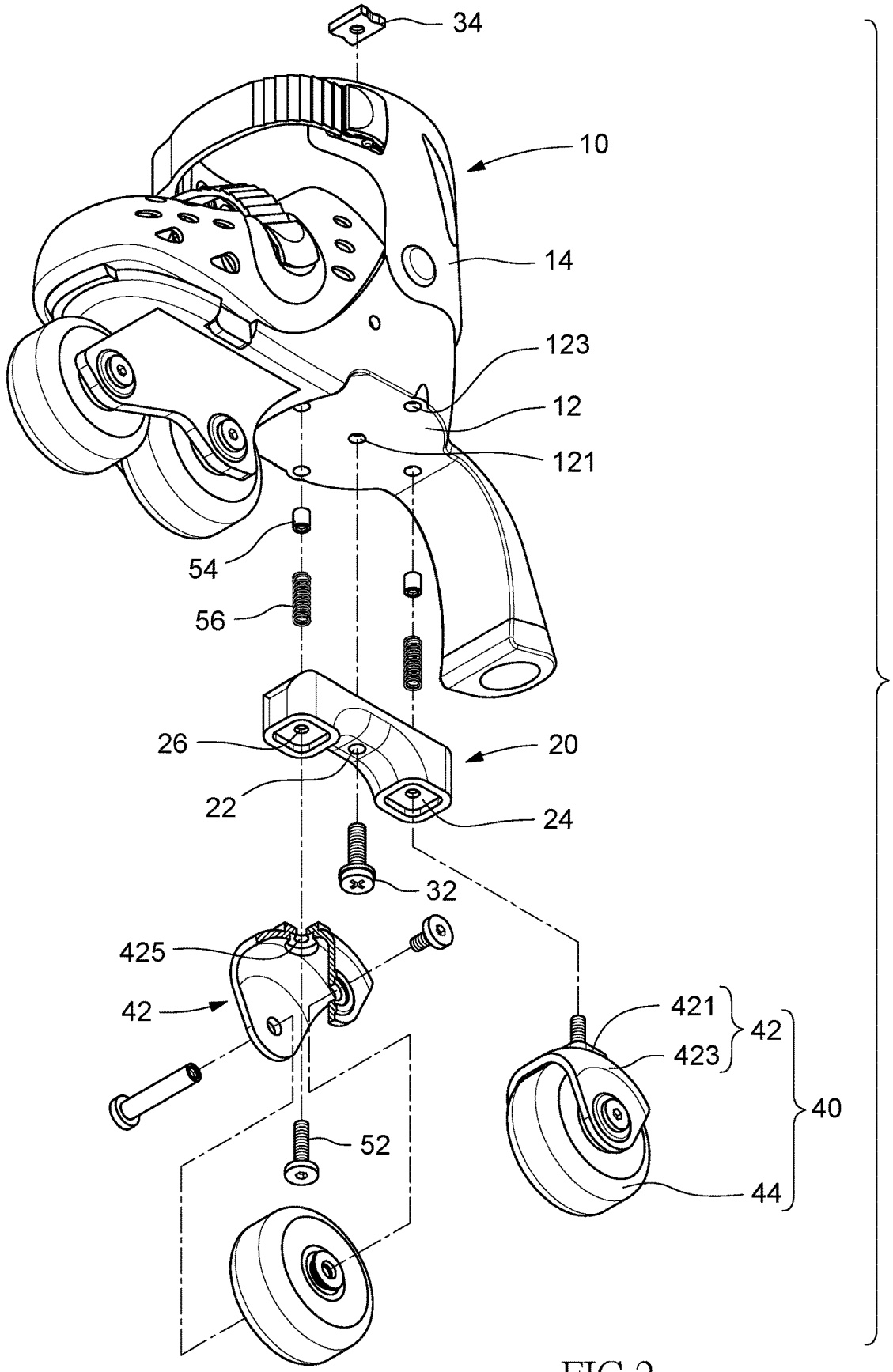
FIG. 2 is an exploded view of the roller skate shown in FIG. 1.
Figure 3:
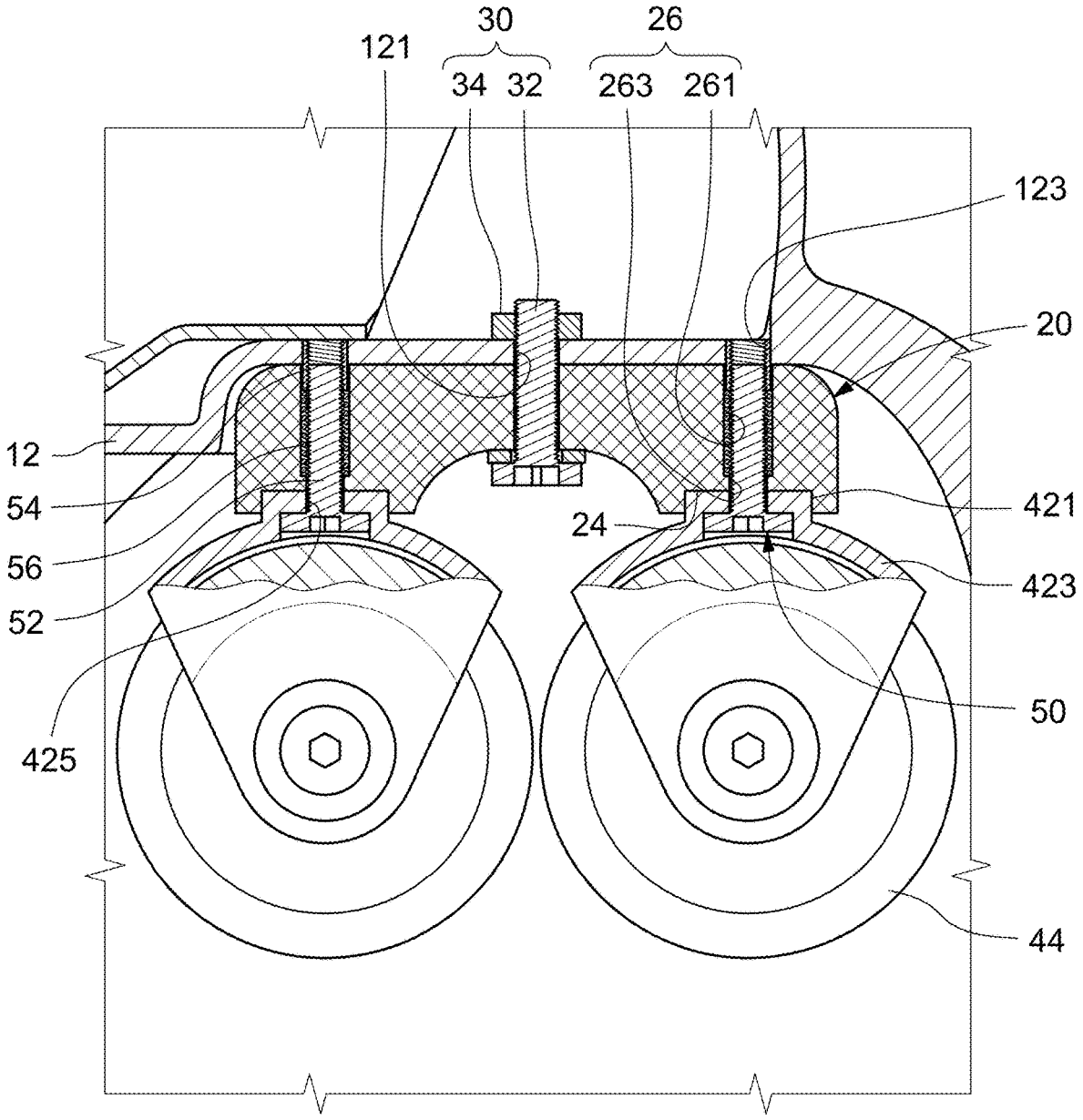
FIG. 3 is a cross-sectional view of the roller skate shown in FIG. 1.
Figure 4:
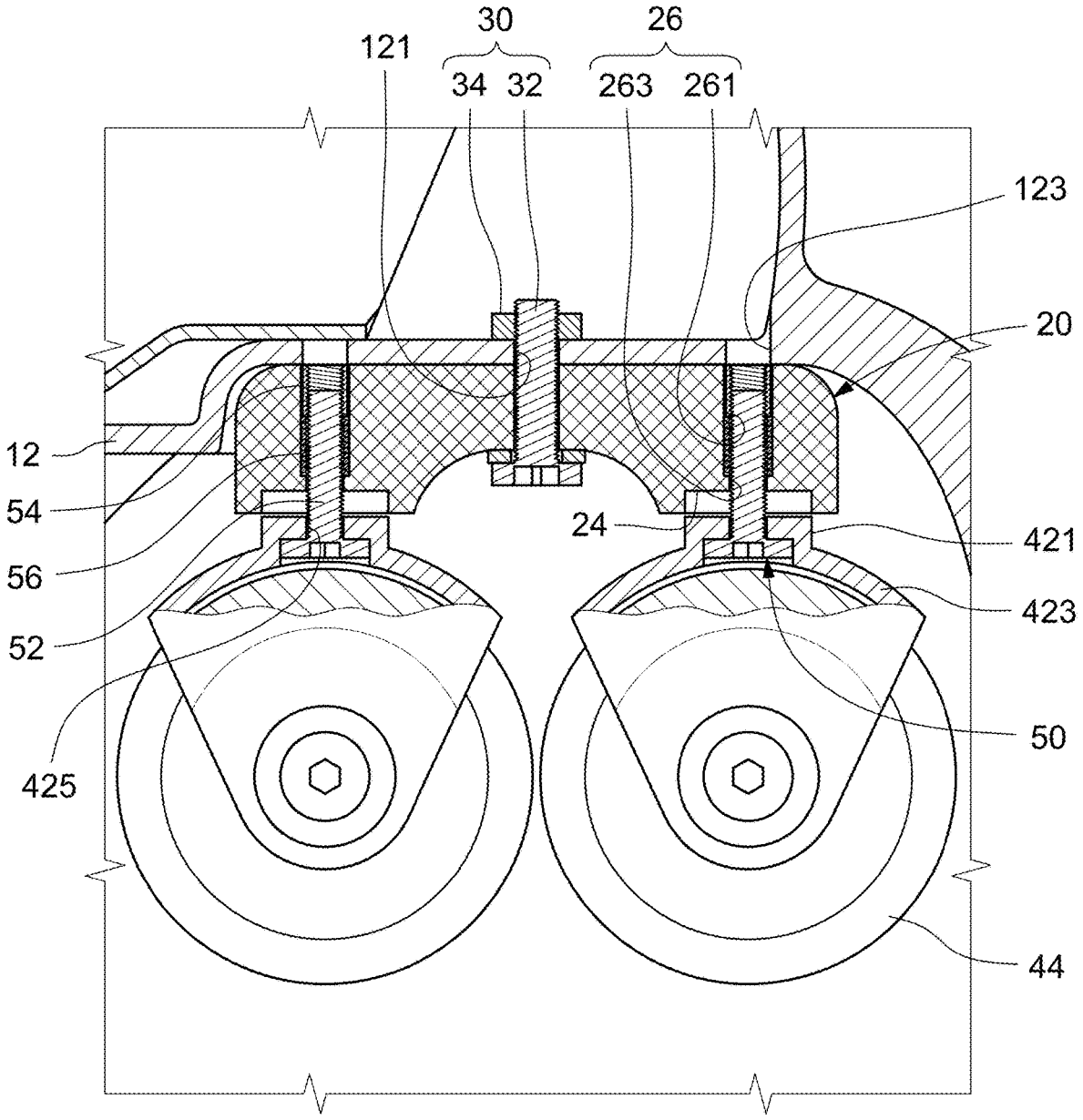
FIG. 4 is a cross-sectional view of the roller skate in another position than shown in FIG. 3.
Figure 5:
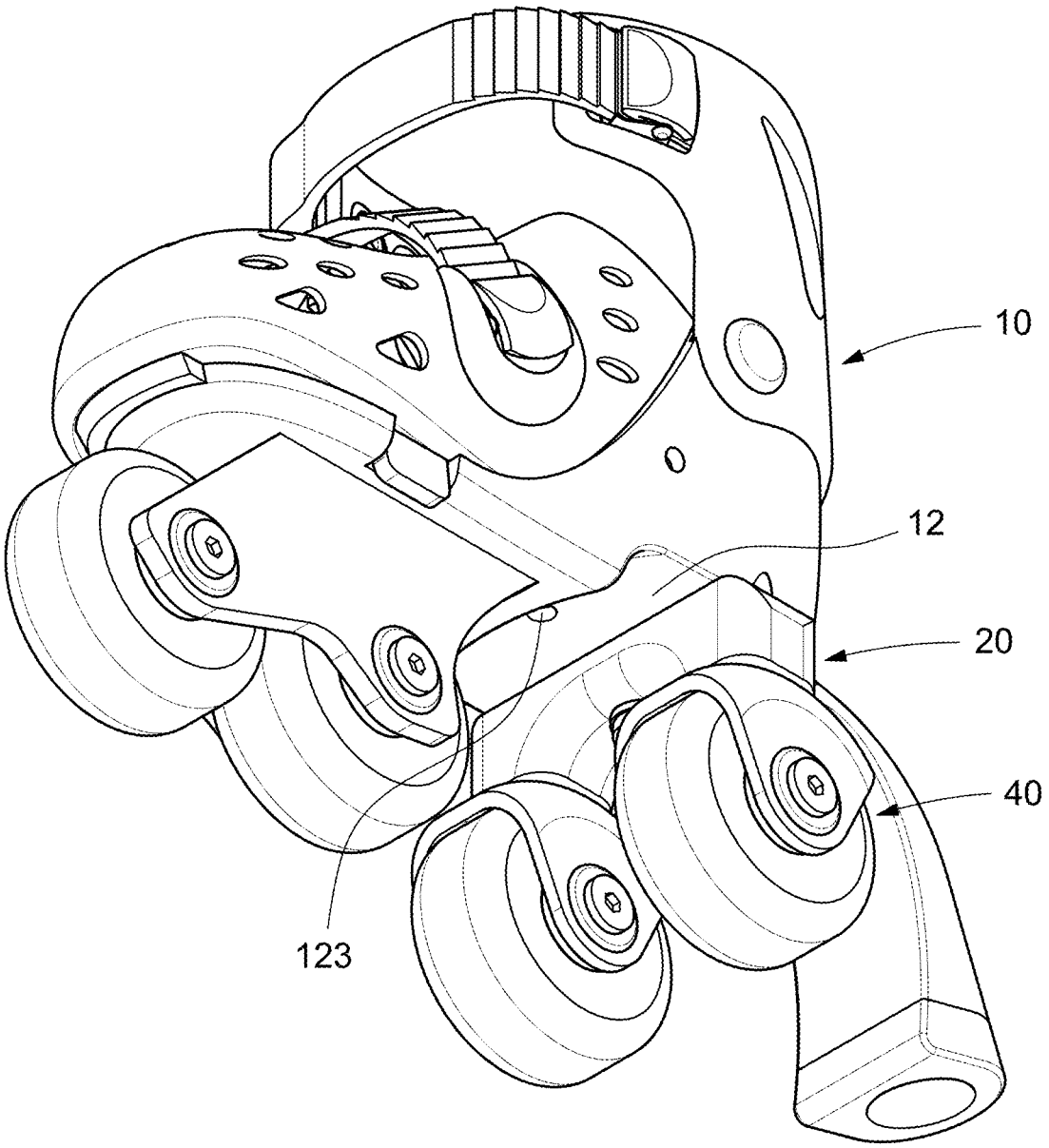
FIG. 5 is a perspective view of the roller skate in another position than shown in FIG. 1.
Figure 6:
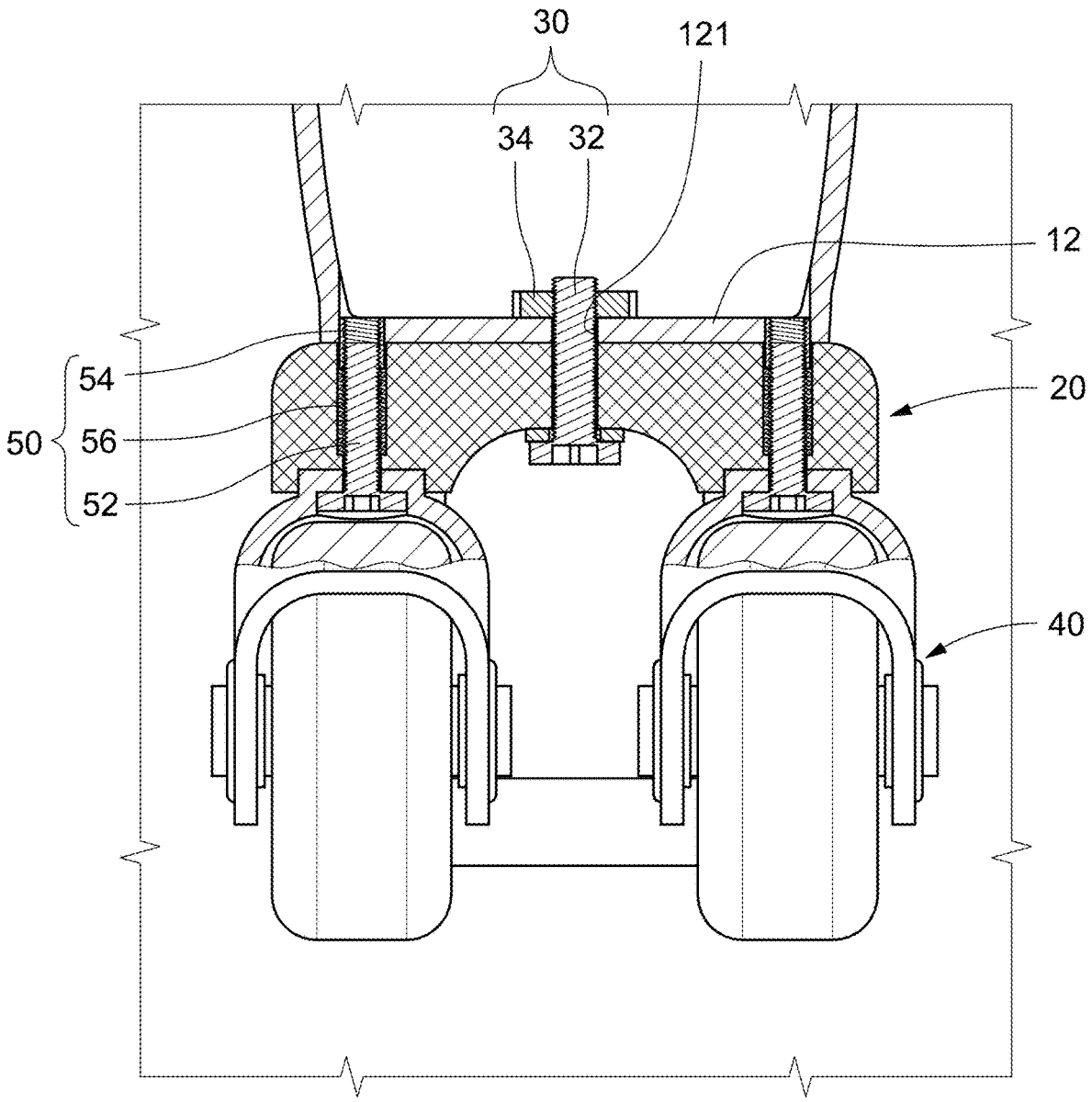
FIG. 6 is a cross-sectional view of the roller skate shown in FIG. 5.

Referring to FIGS. 1 through 3, a roller skate is easily switchable between an in-line position and a side-by-side position according to the present invention. The roller skate includes a boot 10, a beam 20, a fastening unit 30, multiple rolling units 40 and multiple connecting units 50.

The boot 10 includes a sole 12 formed beneath a vamp 14. The sole 12 includes four bores 123 evenly arranged about an aperture 121 so that they become a cruciform formation. The aperture 121 extends throughout the sole 12. Preferably, the bores 123 are only made in a lower face of the sole 12, i.e., the bores 123 do not extend throughout the sole 12.

The beam 20 includes an orifice 22 located between two recesses 24 in communication with two stepped holes 26. The orifice 22 extends throughout the beam 20. The recesses 24 are made in a lower face of the beam 20. The recesses 24 are polygonal and preferably square. Each of the stepped holes 26 extends throughout the beam 20. Each of the stepped holes 26 is coaxial with a corresponding one of the recesses 24. Each of the stepped holes 26 includes a larger section 261 and a smaller section 263 in diameter.

The fastening unit 30 includes a threaded bolt 32 for engagement with a nut 34. The threaded bolt 32 is inserted in the orifice 22 of the beam 20 and the aperture 121 of the boot 10 before it is engaged with the nut 34, which is located on an upper face of the sole 12. Preferably, the nut 34 is not rotatable relative to the sole 12.

Each of the rolling units 40 includes a roller 44 and a supporting element 42. The supporting element 42 includes an arched portion 423, a positioning portion 421 formed on the arched portion 423, and a perforation 425 extending throughout the positioning portion 421 and the arched portion 423. The positioning portion 421 is polygonal and preferably square corresponding to the recesses 24. The arched portion 423 is connected to the roller 44.

Each of the connecting units 50 includes a screw 52, a detent 54 and a spring 56. The detent 54 includes a screw hole. The screw 52 is inserted in the perforation 425 of a corresponding one of the supporting elements 42 and a corresponding one of the stepped holes 26 of the beam 20 before it is inserted in the screw hole of the detent 54. The detent 54 is insertable in a selected one of the stepped holes 26 of the beam 20. Preferably, the profile of the detent 54 is smaller than that of the larger section 261 of the corresponding stepped hole 26 but larger than that of the smaller section 263 of the corresponding stepped hole 26. Preferably, the spring 56 is a helical spring extending around the screw 52. The spring 56 is compressed between a shoulder between the larger and smaller portions 261 and 263 of the corresponding stepped hole 26 and the detent 54. Thus, the detent 54 normally extends in a selected one of the bores 123 of the sole 12 from the beam 20, thereby keeping the beam 20 in position relative to the sole 12.

Normally, the fastening unit 30 keeps the beam 20 in contact with the boot 10, and the spring 56 of the connecting unit 50 pushes the detent 54 in a selected one of the bores 123 of the boot 10. Thus, the rollers 44 is in the in-line position or the side-by-side position relative to the sole 12.

To switch the rollers 44 between the in-line position and the side-by-side position, the threaded bolt 32 is slackened relative to the nut 34 to allow the beam 20 to be moved from the sole 12. The supporting elements 42 are moved from the sole 12. Thus, the connecting units 50 are moved from the sole 12. Accordingly, the detents 54 of the connecting units 50 are moved from the bores 123 of the sole 12, and the springs 56 are compressed by the detents 54. Then, the beam 20 is pivoted relative to the sole 12. The detents 54 do not have to be completely located in the stepped holes 26.

As the supporting elements 42 are moved from the sole 12, the positioning portions 421 of the supporting elements 42 are moved from the recesses 24 of the beam 20. Then, the rolling units 40 are pivoted relative to the beam 20. Now, the supporting elements 42 are released to allow the positioning portions 421 of the supporting elements 42 to enter the recesses 24 again. The detents 54 are inserted in two of the bores 123.

After the beam 20 is pivoted to a new position relative to the sole 12, and the supporting elements 42 are pivoted to a new position relative to the beam 20, the threaded bolt 32 is tightly engaged with the nut 34 so that the beam 20 is in tight contact with the sole 12.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A roller skate comprising:

a boot (10) comprising a sole (12) formed with an aperture (121) and bores (123) arranged around the aperture (121);

a beam (20) comprising an orifice (22), two recesses (24) on two opposite sides of the orifice (23), and two stepped holes (26) in communication with the recesses (24);

a fastening unit (30) comprising a threaded bolt (32) inserted in the orifice (22) and the aperture (121) and a nut (34) engaged with the threaded bolt (32);

multiple supporting elements (42) each of which comprises an arched portion (423) for supporting a roller (44) and a positioning portion (421) formed on the arched portion (423) and insertable in a selected one of the recesses (24); and multiple connecting units (50) each of which comprises:

a detent (54) movable in a corresponding one of the stepped holes (26); and a spring (56) compressed between the detent (54) and a shoulder of a corresponding one of the stepped holes (26) so that the spring (56) tends to synchronously push the detent (54) in a selected one of the bores (123) to prevent the beam (20) from rotation relative to the sole (10) and insert one of the positioning portions (421) in one of the recesses (24) to prevent one of the supporting elements (42) from rotation relative to the beam (10).

2. The roller skate according to claim 1, wherein the bores (123) are evenly located around the aperture (121).

3. The roller skate according to claim 1, wherein the positioning portion (421) is shaped in compliance with the recesses (24).

4. The roller skate according to claim 1, wherein each of the supporting elements (42) comprises a perforation (425) extending throughout the positioning portion (421) and the arched portion (423), wherein each of the connecting units (50) further comprises a screw (52) inserted in the perforation (425) and one of the stepped holes (26), wherein the detent (54) is attached to the screw (52), wherein the spring (56) extends around the screw (52).

* * * * *